United States Patent [19]

Sakoda

[11] Patent Number: 4,700,035

[45] Date of Patent: Oct. 13, 1987

[54] MICROWAVE OVEN DOOR

[75] Inventor: Yasuhiro Sakoda, Wakayama, Japan

[73] Assignee: Sharp Kabushiki Kaisha, Japan

[21] Appl. No.: 847,116

[22] Filed: Apr. 3, 1986

Related U.S. Application Data

[63] Continuation of Ser. No. 596,902, Apr. 5, 1984, abandoned.

[30] Foreign Application Priority Data

Apr. 20, 1983 [JP] Japan ..... 58-60023[U]

[51] Int. Cl.[4] ..... H05B 6/64

[52] U.S. Cl. ..... 219/10.55 D; 219/10.55 F

[58] Field of Search ..... 219/10.55 D, 10.55 R, 219/10.55 F; 174/35 R, 35 GC, 35; 126/190, 198, 200

[56] References Cited

U.S. PATENT DOCUMENTS 4,215,258 7/1980 Nelson et al. ..... 219/10.55 D 4,254,318 3/1981 Ohkawa et al. ..... 219/10.55 D

*Primary Examiner*—E. A. Goldberg

*Assistant Examiner*—M. M. Lateef

*Attorney, Agent, or Firm*—Birch, Stewart, Kolasch & Birch

[57] ABSTRACT

A microwave oven door assembly that effectively saves assembly time and lowers cost by significantly reducing the number of the door component parts. By inserting a plurality of projections provided at the inner periphery of the choke cover into the inner door plate, both the choke cover and inner door plate are secured. In addition, by causing the projections formed on the choke cover to be coupled with openings formed in the front screen, the choke cover and the front screen are securely fixed together.

2 Claims, 5 Drawing Figures

PRIOR ART

MICROWAVE OVEN DOOR

This application is a continuation of application Ser. No. 596,902 filed on Apr. 5, 1984, now abandoned.

BACKGROUND OF THE INVENTION

The present invention relates to a microwave oven door, and more particularly, to a door assembly comprising a simple configuration to achieve improved operation efficiency.

FIG. 1 is a simplified sectional view of a conventional microwave oven. A heating chamber 3 is provided inside the external sheet 1 of a microwave oven, while a magnetron 2 generating high frequency microwaves is provided in the upper part of said heating chamber 3. Food 5 to be heated by high frequency microwaves is disposed in a plate on the bottom of said chamber 3. In reference to an enlarged sectional view shown in FIG. 2, a typical configuration of a conventional door assembly shown in FIG. 1*a* is described below.

In FIG. 2, a shield 11 is made of internal transparent glass 9 that makes.up an internal door screen and punching metal, while said shield 11 is sandwiched by plate 8 connected to door 7 and an inner door plate 10 by means of screw 12. Choke cover 13 is provided in the periphery of an opening of cavity 6 formed by said door 7 and inner door plate 10, while the choke cover 13 is also sandwiched by door 7 and the inner door plate 10 when installing transparent glass 9 and shield 11. Front screen 14 is secured to door 7 across the screen hold plate 15 via screw 17. A decoration board 16 is provided at the external periphery of door 7 to conceal said screen hold plate 15 and screw 17 securing it. As shown in FIG. 1, conventionally, the door of a microwave oven is held by screws, thus making it necessary to provide a decoration board to conceal screws. Such a configuration requires a number of parts, thus requiring much labor during assembly, and making it difficult to reduce costs.

OBJECT AND SUMMARY OF THE INVENTION

In the light of such a disadvantage thus described, the present invention aims at providing a microwave oven with a simplified door assembly at low cost by minimizing the door component parts in order that the assembly process can be significantly simplified.

Briefly speaking, the present invention provides such a door assembly comprising a configuration in which a choke cover is secured to the inner door plate via projections of said choke cover so that said choke cover can be secured to the front screen by applying said projections.

More particularly, the present invention provides a door assembly of a microwave oven comprising a choke cover and a front screen secured to the inner door plate. The door assembly has a configuration such that a plurality of projections which are provided in the inner periphery of the choke cover are inserted into the inner door plate for securely fixing both the choke cover and inner door plate before finally securing both the choke cover and front screen by causing projections of the choke cover to be coupled with the opening formed in the front screen. Such a door assembly thus embodied by the present invention effectively and significantly reduces the number of the door component parts, thus providing a saving in time and labor during the assembly operation and also resulting in a reduced cost.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
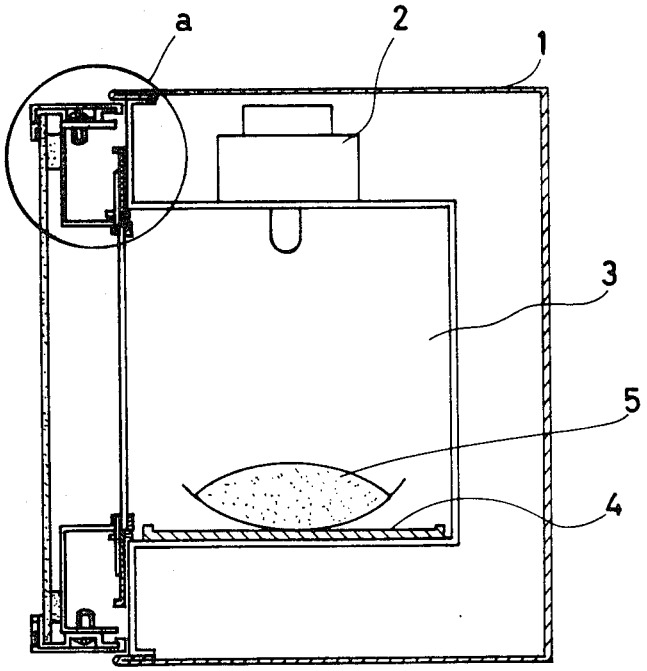
FIG. 1 is a simplified sectional view of a microwave oven.
Figure 2:
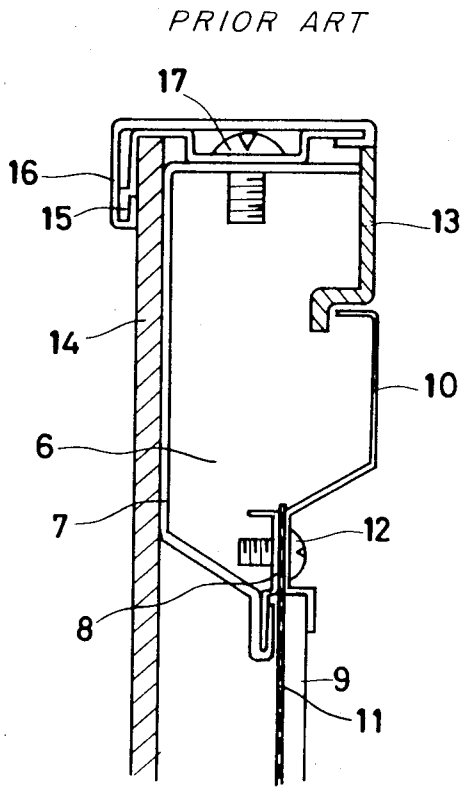
FIG. 2 is an enlarged sectional view of the door of a conventional microwave oven.
Figure 3:
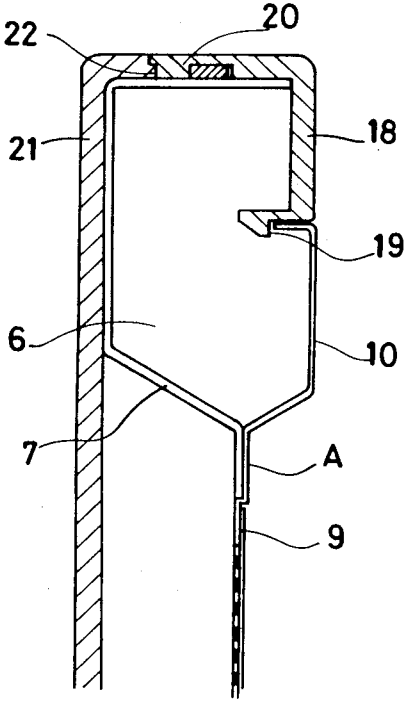
FIG. 3 is an enlarged sectional view of a microwave oven denoting a preferred embodiment of the present invention.
Figure 4:
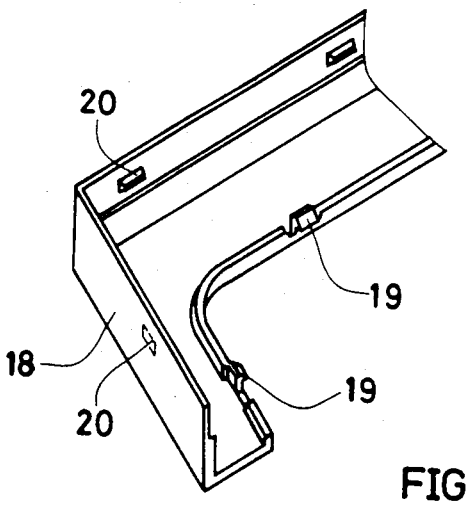
FIGS. 4 and 5 are respectively the perspective views of the choke cover and front screen of a preferred embodiment of the present invention.
Figure 5:
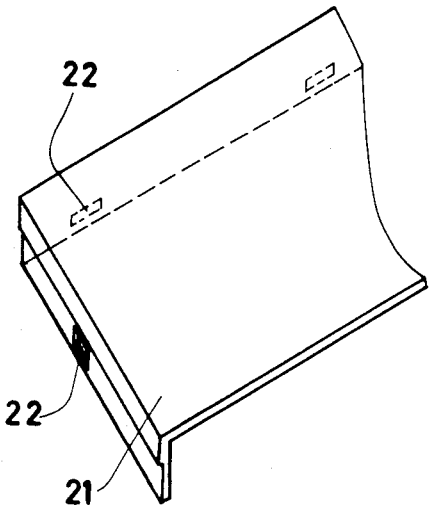

FIG. 3 is an enlarged sectional view of a microwave oven denoting a preferred embodiment of the present invention. Any elements which have a function identical to conventional element are identified by the same reference numerals, with detailed explanations being eliminated with respect thereto.

In FIG. 3, door 7 and an inner door plate 10 are welded together at point A, while a number of punched holes are provided in the center screen of the inner door plate 10. A transparent glass 9 is provided to prevent vapor from entering through punched holes. A choke cover 18 is provided to cover a range from the opening of the choke cavity 6 formed by door 7 and inner door plate 10 to the external door periphery, while projections 19 are formed at proper intervals in the inner periphery of the choke cover 18. A plurality of projections 20 formed along the external periphery of the choke cover 18 are coupled with a plurality of openings 22 formed along the external periphery of the front screen 21, thus causing both the choke cover 18 and front screen to be securely fixed. Next, procedures for assembling the door unit embodied by the present invention are described below.

First, a transparent glass 9 is adhered to a unit comprising a door 7 and an inner door plate 10 is welded at point A, to the door and a choke cover is inserted into the front screen 21 from both sides projections 19 of the choke cover 18 are then inserted into the inner door plate 10 so that they can be securely fixed together to complete the door assembly.

As described above, since the preferred embodiment of the present invention has made it possible to securely fix the choke cover 18 by tightly coupling it with both the inner door plate 10 and front screen 21, the front screen 21 can be installed to the front of the door assembly by eliminating a conventional decoration panel 16, otherwise needed for concealing screws 17 that used to secure both the choke cover 13 and front screen.

As a result, a flat and simplified appearance is achieved without a noticeable concave or convex appearance.

The invention being described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A microwave oven door assembly comprising an oven door secured to an inner door plate, said oven door and inner door plate defining a partially enclosed choke cavity, a screen disposed in parallel, juxtaposition with respect to the door to permit an operator to view the interior of the microwave oven through said door assembly, said screen having end portions thereof which extend around the peripheral outer edge of the door, said end portions being provided with a plurality of openings, a choke cover provided with a plurality of projections at both end portions thereof, said projections at one end portion thereof being in operative engagement with the openings in said screen and said projections at the other end portion thereof being in operative engagement with the inner door plate, whereby the closing of the choke cavity is completed, said choke cavity preventing the leakage of microwave energy through the door assembly.

2. The microwave oven door assembly of claim 1 wherein the oven door is sandwiched between the screen and a portion of the choke cover.

* * * * *